United States Patent [19]

Praitoni et al.

[11] Patent Number: 4,756,749

[45] Date of Patent: Jul. 12, 1988

[54] PROCESS FOR CONTROL OF CONTINUOUS CASTING CONDITIONS

[75] Inventors: Alberto Praitoni, Pomezia; Pietro Tolve, Rome, both of Italy

[73] Assignee: Centro Sviluppo Materiali S.p.A., Rome, Italy

[21] Appl. No.: 939,402

[22] Filed: Dec. 8, 1986

[30] Foreign Application Priority Data

Dec. 6, 1985 [IT] Italy ..... 48890 A85

[51] Int. Cl.[4] ..... C21C 5/52

[52] U.S. Cl. ..... 75/10.22; 75/46; 164/420; 266/236

[58] Field of Search ..... 75/46, 10.12, 10.22; 266/236; 164/420

[56] References Cited

U.S. PATENT DOCUMENTS

| | | | |
|---|---|---|---|
| 3,887,171 | 6/1975 | Neuhaus | 266/236 |
| 4,043,543 | 8/1977 | Courtenay et al. | 266/236 |
| 4,645,534 | 2/1987 | D'Angelo et al. | 75/10.22 |

*Primary Examiner*—Melvyn J. Andrews

*Attorney, Agent, or Firm*—Young & Thompson

[57] ABSTRACT

A process of continuous casting of liquid steel from a tundish having a plurality of casting holes through which liquid steel moves downwardly into a plurality of strands. The liquid steel is discharged into the tundish from a ladle and moves in opposite directions toward two adjacent holes from at least one node comprising a point from which liquid steel moves in different directions toward different holes. The liquid steel is subjected to the heating effect of a heat source at at least one such node. The heat source is a transferred arc plasma torch.

5 Claims, 1 Drawing Sheet

PROCESS FOR CONTROL OF CONTINUOUS CASTING CONDITIONS

Figure 1:
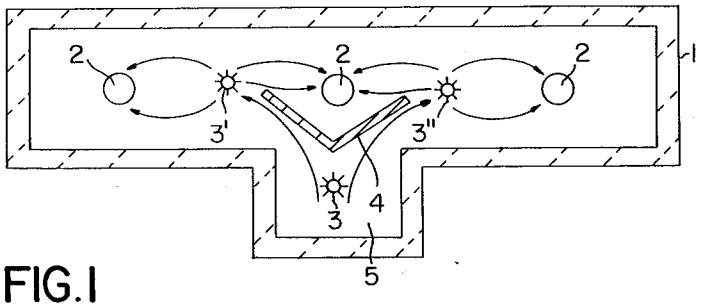

This invention refers to an improved process for controlling continuous casting conditions. In particular, it concerns means for controlling and regulating the temperature of liquid steel in the tundish. Continuous casting of steel is a well-known, widely-used process. However, no satisfactory solution has yet been found to the demands posed by recent technological and economic trends towards higher casting speed and better semiproduct quality (e.g. low level of segregation, low percentage of surface and internal defects such as cracks, axial porosity and the like, as well as solidification structures).

The solution of these problems is very important, not only to improve quality as such, but also because of the further possibilities of technological development that could derive therefrom. In fact, for instance, the possibility of widespread adoption of direct rolling of the cast semi, presently practised by only a very few producers, or even the possibility of continuously casting products only a few centimeters thick to be direct hot rolled, would be very radical innovations and would bring great benefits to the steel industry from the technical and economic aspects that would help alleviate the present critical situation of which everyone is aware. In very general terms it is reasonable to hold that most quality problems affecting continuously cast semis are due to fluctuations or variations in casting conditions; two of the operating parameters universally recognized as being most significant in this regard are temperature and flow rate of steel poured into the mould of the continuous casting machine. In particular, it is considered essential that these parameters should remain as constant as possible during casting.

Where temperature is concerned, of course, it is necessary to cast the steel at a temperature higher than the liquidus. This temperature difference, known as superheat, must be high enough to permit the regular performance of casting operations, but it should also be as small as possible for two reasons. The first is that it is costly to raise the temperature of liquid steel in the furnace. The second is that the solidification process of steel in the mould has a marked effect on the quality of the resulting semiproduct, and that this solidification is influenced by the superheat, currently held to be the fundamental parameter controlling final structure. It has been found, in fact, that a superheat of less than 10° C. greatly improves both segregation and the solidification structure (very high percentage of equiaxic structure).

Another important parameter is uniformity of steel casting temperature; it has been ascertained that fluctuations in temperature during continuous casting cause uneven solidification which, in turn, leads to the formation of longitudinal surface cracks and porosity and central cracks. Furthermore, in high-speed continuous casting, high superheat and possible temperature fluctuations result in insufficient formation of a solid skin, thus enhancing the risk of cracks, especially on the corners, or even of breakout.

It is evident from this brief exposition of the situation that continuous casting calls for a predetermined constant superheat which is as low as possible. However, this entails the risk of the steel solidifying before it has been cast, especially in zones where there is the greatest heat loss, such as the nozzles; of course, the lower the superheat, the greater the risk.

The solutions proposed so far for this problem have not proved wholly satisfactory, for a variety of reasons. For instance, it has been proposed that the steel in the ladle or the tundish should be kept hot by means of arc electrodes or resistances buried in the walls of these containers.

Apart from the low thermal efficiency of such systems, which makes them very costly to use, there still remains the problem of keeping the temperature of the steel constant at the various nozzles.

This invention is designed to overcome these difficulties by a simple, effective process which permits the steel to be tapped from the furnace at a desirably low temperature, of casting the steel continuously with a fixed, minimum superheat, and of preventing partial or complete blockage of the nozzles by solidified steel.

In U.S. Pat. No. 4,645,534 it was proposed that the steel in the ladle and/or the tundish be heated by electrical means, preferably involving use of a plasma torch. Further studies and trials in this field have, however, revealed that there is another problem, namely that in continuous casting on several strands it may happen that the temperature of steel cast on two different strands at any given moment is diverse. This is clearly an unsatisfactory situation, since it means that it is impossible to run all the casting strands in the same manner, as regards cooling rate and hence metallurgical solidification conditions. It has been found, in fact, that it does not suffice to increase the number of heating points to ensure a sufficiently uniform temperature on the various casting strands.

A fluid dynamics study of tundishes has revealed a number of general flow patterns which result in the paths taken by the steel and the residence times being effectively different on the various casting strands; the situation is relatively simple in the case of tundishes with only a few nozzles, but it becomes extremely complex in plants which have many strands fed from the same tundish. Under such conditions it would be necessary to provide heating on every strand, but this is clearly unsatisfactory both because of the high cost of such a solution and because each strand would presumably require quite specific action which would differ from that of the others.

It emerges from the aforementioned fluid dynamics study, however, that there exist steel flow "nodes", a node being defined as a place within the liquid mass where steel flow splits into two or more flows, the algebraic sum of flows in the node being zero. According to the present invention these nodes can be advantageously exploited as heating zones, or preferably it is possible to create nodes such that the paths between these and two or more casting holes are equivalent. Consequently, the improved process as per this invention is characterized by the fact that within the mass of liquid steel moving in a tundish, flow nodes are identified each being in a central location vis-à-vis at least two casting holes, and that in at least one part of these nodes the steel is subjected to the heating effect of a high-temperature, non-polluting heat source.

Preferably, these heating nodes are deliberately created by inserting a baffle along the path of the steel.

Again preferably, one of the nodes to be heated is located near the zone where the steel from the ladle is discharged into the tundish.

As regards the heat source, this can advantageously take the form of a plasma torch, preferably of the transferred arc type, with direct current or alternating current supply, because of the high thermal efficiency of this device, the possibility of delivering large quantities of heat concentrated in a very well defined space, the good possibility of regulation, the absence of pollution and the very limited dimensions.

Figure 2:
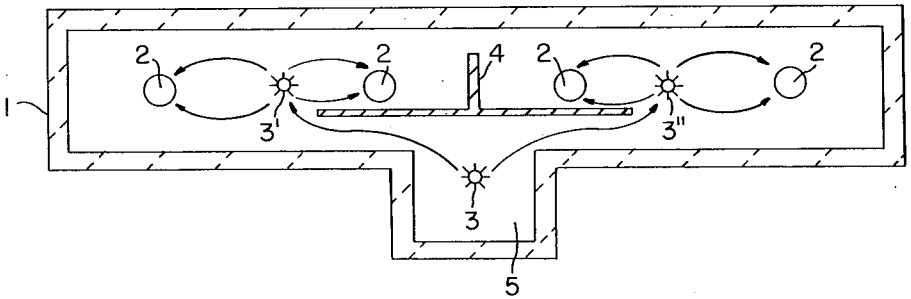

The present invention will now be described in greater detail in relation to some embodiments that are illustrated, purely by way of exemplification and without limitations as regards the invention and claims thereto, in the accompanying drawing where:

FIG. 1 is a schematic plan view of an embodiment in a tundish with three casting holes FIG. 2 is a schematic plan view of an embodiment in a tundish with four casting holes.

With reference to both figures of drawing, it is apparent that a tundish 1 is provided with a number of casting holes 2 and with a receiving well 5, namely a zone where the molten steel is discharged from a ladle set at a higher level (not shown) into the tundish.

It is evident that there are various paths from the receiving well to the various casting holes, so the time it takes the steel to travel these paths and hence the amount of cooling involved will vary case by case.

According to the invention a baffle 4 is placed inside the tundish in such a manner that the steel is forced to pass around it before proceeding towards any given casting hole. In this way specific nodes 3' and 3'' are created (in positions that are different from those that would occur without baffle 4) where the heating devices are installed, said nodes being in a central location between the nearest two casting holes. Here the expression "central location" means a position which is specially chosen both as regards distance and metal flow. Thus, for example, in FIG. 1 the middle casting hole receives steel from both node 3' and node 3'', so the flow of steel from these nodes towards the middle casting hole is presumably slower than towards the more external holes. It follows, therefore, that the steel will stay longer on that path and tend to cool more, so nodes 3' and 3'' will be set a little closer to the middle hole than to the external ones.

In both drawings, node 3 is generated by the flow of steel from the ladle into the tundish (and then by the flows towards nodes 3' 3'', said flows being schematized by arrows, and then from nodes 3' and 3'' towards the casting holes), and it is preferably heated. Temperature control and use of the plasma torch as per this invention is also particularly interesting because of the metallurgical treatments it permits. In fact, low superheat does not enable full use to be made of some liquid slags for secondary metallurgical treatments, their reactivity being temperature dependent. The introduction of such slags, in the solid state, or even of alloy elements or special gases, into the plasma of the torch directed onto the nodes results in high yields and homogeneous distribution of the treatment in the steel.

We claim:

1. In a process of continuous casting of liquid steel from a tundish having a plurality of casting holes through which liquid steel moves downwardly into a plurality of strands, the liquid steel being discharged into the tundish from a ladle and the liquid steel moving in opposite directions toward two adjacent said holes from at least one node comprising a point from which liquid steel moves in different directions toward different said holes; the improvement comprising subjecting the liquid steel to the heating effect of a heat source at at least one said node.

2. A process as claimed in claim 1, in which said at least one node is in direct alignment between two adjacent said holes.

3. A process as claimed in claim 1, and mechanically deflecting the flow of said liquid steel in two different directions by means of a fixed upright baffle thereby to create a said node where said liquid steel separates to flow in said two different directions.

4. A process as claimed in claim 1, there being a said node where the steel is discharged into the tundish from said ladle, and applying said heat source to the last mentioned node.

5. A process as claimed in claim 1, in which said heat source is a transferred arc plasma torch.

* * * * *